United States Patent [19]

Czumak

[11] Patent Number: 4,721,974

[45] Date of Patent: Jan. 26, 1988

[54] FILM PROCESSING KIT

[75] Inventor: Frank M. Czumak, Salem, N.H.

[73] Assignee: Polaroid Corporation, Cambridge, Mass.

[21] Appl. No.: 26,689

[22] Filed: Mar. 17, 1987

[51] Int. Cl.[4] ..... G03D 5/06

[52] U.S. Cl. ..... 354/303; 354/318

[58] Field of Search ..... 354/303, 304, 305, 312, 354/313, 314, 317, 318, 301

[56] References Cited

U.S. PATENT DOCUMENTS

| | | | |
|---|---|---|---|
| 3,357,337 | 12/1967 | Land et al. | 354/318 |
| 3,453,138 | 7/1969 | Chen et al. | 354/319 |
| 4,371,249 | 2/1983 | Czumak et al. | 354/304 |
| 4,537,485 | 8/1985 | Saito | 354/318 |
| 4,607,928 | 8/1986 | Nangeroni | 354/318 |

*Primary Examiner*—A. A. Mathews

*Attorney, Agent, or Firm*—Alfred E. Corrigan

[57] ABSTRACT

A disposable kit of the type adapted for use in film processing apparatus in the processing of a roll of exposed instant type transparency film, preferably of the 35 mm format. The kit includes a two-section housing which encloses a roll of sheet material, a container of processing liquid and a nozzle dispenser to apply a coating of the liquid to one side of the sheet material as it is being drawn from the housing prior to being laminated to a length of exposed film. After the appropriate length of sheet material is withdrawn from the kit and the processing cycle is completed, the strip of sheet material is retracted into the kit. A fluted idler roller is mounted in the housing to minimize the sideward migration of any processing liquid remaining on the sheet material when it is retracted into the kit.

13 Claims, 3 Drawing Figures

FILM PROCESSING KIT

BACKGROUND OF THE INVENTION

1. Field of the Invention

This invention relates to a disposable kit for use in an apparatus for processing individual rolls of 35 mm instant type transparency film.

2. Description of the Prior Art

The present invention relates to an improvement in a disposable kit of the type constructed to be placed within a film processor where its contents will be used in the processing of individual rolls of 35 mm instant type transparency film such as is disclosed in the U.S. Pat. No. 4,371,249 issued Feb. 1, 1983 to Czumak et al. The patent discloses a kit enclosing a roll of sheet material and a container of processing liquid which is applied to one surface of the sheet material as it is withdrawn from the kit for lamination with a film to be processed. A problem with the apparatus disclosed in the patent is that when the sheet material is subsequently retracted into the kit after the film has been processed, there was too high a tension on the sheet material as it moved in engagement with guide surfaces on the kit during its transition between substantially horizontal movement to substantially vertical movement. In an effort to correct this problem, a cylindrically configured idler roller was rotatably mounted between walls of the kit at this transition point. However, it was found that the idler roller had a tendency to resist rotation because of the relatively low coefficient of friction presented by the processing liquid coated surface of the sheet material. Thus, the cylindrical idler roller had a tendency to cause the processing liquid on the sheet material to build up at a point immediately before the sheet material moved into engagement with the cylindrical idler roller. Further, the idler roller would cause the residue of the processing liquid and any which had dripped onto the sheet material during the time that the sheet material was not moving to be spread transversely on the sheet. Some processing liquid flows off the edges of the sheet material during the retraction process. Such transverse spreading causes undesirable leakage from the kit and the deposit of the processing liquid on the journals of the idler roller, thus increasing its resistance to rotation. Accordingly, there is a need to minimize the transverse migration of the processing liquid on the strip of sheet material when it is retracted into the kit.

SUMMARY OF THE INVENTION

A disposable kit which is adapted for use within a film processing apparatus includes a housing of two separable sections with a length of sheet material wound on a roller mounted in the kit. A rupturable package of processing liquid is mounted within the kit in a position to discharge its contents into a container. The container includes a nozzle for dispensing the processing liquid onto one surface of the sheet material when it is withdrawn from the kit for lamination with an exposed length of film for processing.

The film processing apparatus includes means for separating the two-part housing and rupturing the package of processing liquid prior to the time the sheet material is withdrawn from the kit; all of this being done while the processing apparatus is closed to prevent the admission of light which might have an undesirable effect on the film being processed.

After the film processing is completed, the film is separated from the length of sheet material and the sheet material is retracted into the kit. Some of the processing liquid remains on the strip of sheet material when it is brought back into the kit. Additionally, any residue of processing liquid not dispensed when the strip was initially withdrawn from the kit will inherently be deposited by gravity on the sheet material prior to moving it back past the nozzle. It is desirable that any residue of processing liquid be located on the sheet material as it is being rewound on the roller during its retraction into the kit. Because the strip or sheet material makes at least one essentially right angle turn between the nozzle and the roller inside the kit, a fluted idler roller has been installed to affect the turn. Thus, while the contact between the fluted idler roller and the coated surface of the strip is held to a minimum, the ridges of the idler roller will tend to dig into the coated surface and thus result in the idler roller being driven by the strip.

Objects of the invention not obvious from the above summary will be clear from a review of the drawings and the detailed description of the invention which follows.

DETAILED DESCRIPTION OF THE INVENTION

Figure 1:
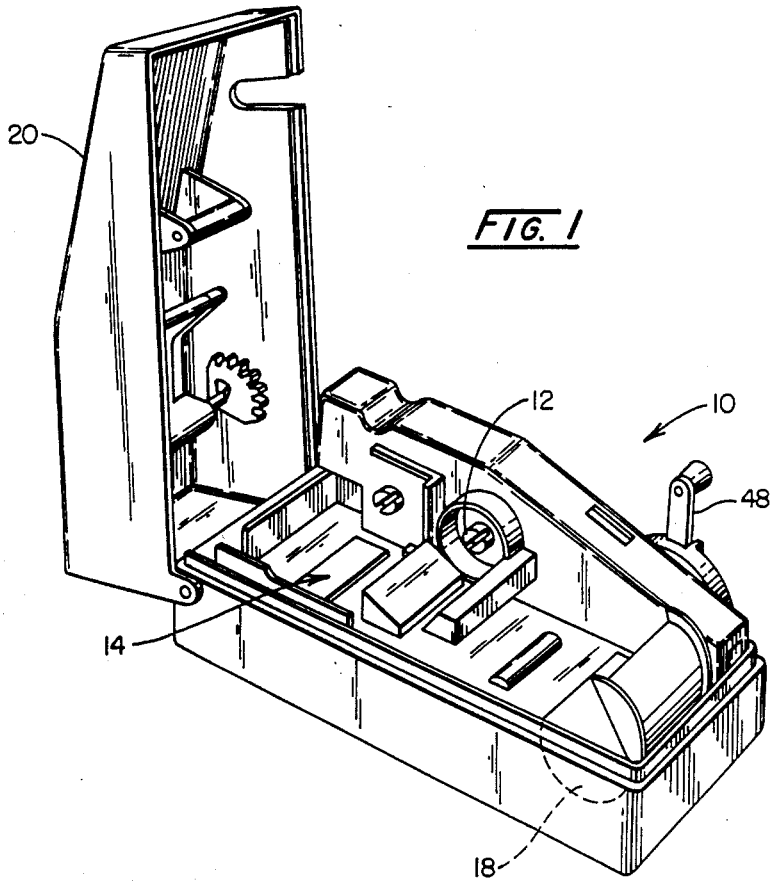
FIG. 1 is a perspective view of the film processing unit.

Looking particularly to FIG. 1, a film processing apparatus 10 includes a mounting axle or drive member 12 for supporting an end of a roller 13 mounted within a 35 mm film cassette 44, the roller supporting a roll of exposed film 42; a cavity 14 to accommodate a disposable kit 16 (best seen in FIGS. 2 and 3); and a two section take-up roller 18 on which the exposed film 42 will be wound for processing. Such processing will take place with the film 42 in contact with a processing liquid and with the lid 20 of the apparatus 10 in a closed position, as will be explained subsequently.

For purposes of understanding the detailed operation of the processing apparatus 10 and the incorporated kit 16 and to the extent necessary for an understanding of this invention, U.S. Pat. No. 4,371,249 is incorporated herein by reference.

Figure 2:
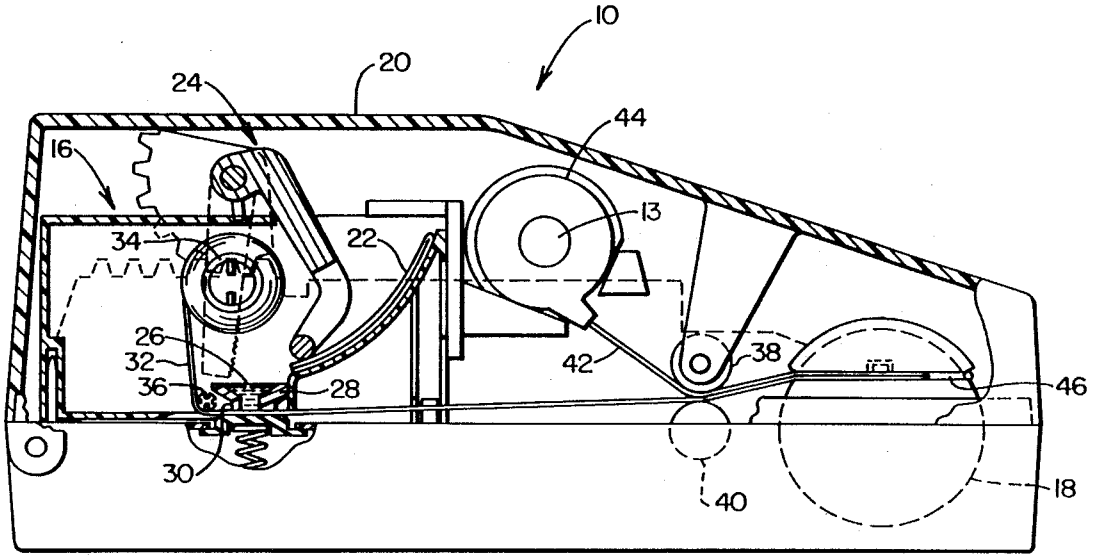
FIG. 2 is a side elevational view of the processor of FIG. 1 with a film processing kit installed, with the loading door closed, and with certain parts omitted or sectioned for reasons of clarity.

Looking to FIG. 2, a package 22 of processing liquid is mounted in the kit 16 and package rupturing apparatus 24 is shown in a position where the liquid contents 26 have been squeezed from the package 22 into a container 28 for subsequent discharge through a nozzle 30.

A strip of thin flexible sheet material 32 is wound on a roller 34 and extends downwardly and around a fluted freely rotatable roller 36, past nozzle 30, out of the kit to laminating rollers 38 and 40 and thence to the take-up roller 18.

Exposed film 42 extends from the film cassette 44 and between rollers 38 and 40 where it is laminated to strip 32 and then to the take-up roller 18. The roller 13 upon which the film 42 is wound within the film cassette 44 is supported in position for rotation by drive member 12.

Figure 3:
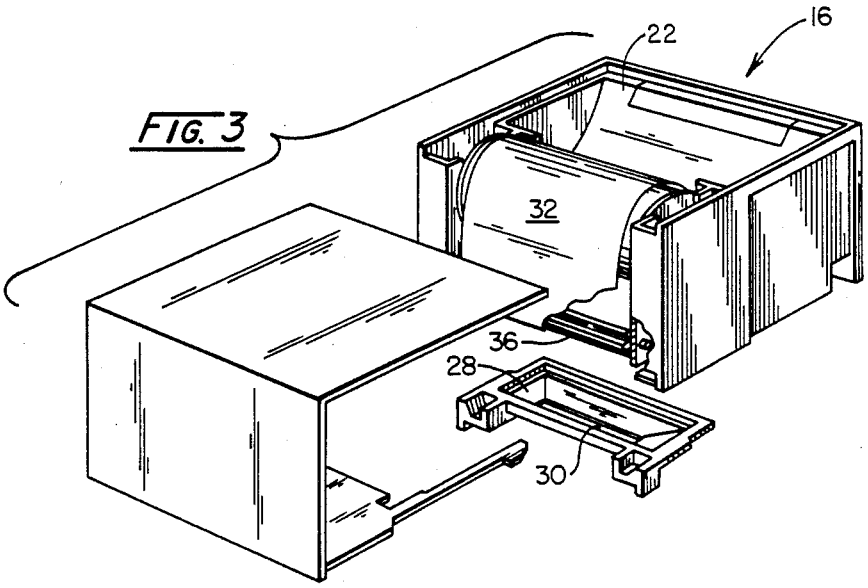
FIG. 3 is a partially exploded perspective view of a disposable film processing kit, partially broken away to show the location of certain moving parts.

FIG. 3 illustrates the parts of the kit 16 in perspective exploded view and particular attention is directed to the location of the fluted idler roller 36. It will be noted that roller 36 is journaled in inwardly extending projections from the side walls of the kit 16 with the axis of the roller 36 parallel to the axis of the roller 34 on which the strip of material 32 is wound.

In operation, the kit 16 and the film cassette 44 are mounted in the open film processing apparatus 10 and then the lid 20 is closed to keep out light. Prior to the closing of the lid 20, the ends of the film 42 and the strip of material 32 are pulled into a split 46 in the take-up roller 18 where they are clamped in position. When the lid 20 is closed, the rollers 38 and 40 are placed in close relationship to cooperate in laminating film 42 to strip 42 as they pass between the rollers 38 and 40.

A series of gears (not shown) operatively associated with a manually operable handle 48 will cause the take-up roller 18 to rotate in clockwise direction as seen in FIG. 2, thereby drawing the film 42 and strip 32 from their respective rollers where they will be pinched into a lamination by rollers 38 and 40 and wound on the take-up roller 18. The viscous processing liquid 26 is deposited on the upper surface of the strip 32 as it moves under nozzle 30. Thus, the processing liquid is sandwiched between strip 32 and the emulsion side of the film 42 when the laminated unit is wound on take-up roller 18.

After a suitable period of processing of from thirty seconds to one minute, or whatever time is appropriate, a lever (not shown) is actuated to disconnect the output of the crank or handle 48 from the take-up roller 18 and redirect its output to the end of the roller 13 upon which the film is to be rewound and to a journal of the roller 34. The manually operated handle 48 is then rotated to retract the film 42 and the strip 32 and rewind them on their original rollers. They will be separated on the rewinding as they emerge from the roller 38 and 40.

During the time that the film 42 and the sheet material 32 are wound upon the take-up roller 18 and the latter is no longer being driven by the crank 48, the processing liquid 26 is being imbibed by the emulsion side of the film 42 in a manner which will result in the formation of a visible image within the film's image-receiving layer. Also, during this time, any excess processing liquid 26 remaining in the container 28 will drip down onto the stationary sheet material 32 located immediately below the container's nozzle 30, thus forming a small puddle of processing liquid. When the above-described processing period is over and the sheet material and film rollers are driven by the crank 48 in a clockwise direction (as viewed in FIG. 2), each of the flutes on the roller 36 scoop a little of the aforementioned puddle of processing liquid 26 from the sheet material 32 as it moves into engagement with a flute and redeposits this excess processing liquid 26 on the sheet material 32 as the latter moves away from the fluted roller 36 and toward the roller 34.

Also, the film 42 is preferably of a type more fully described in U.S. Pat. Nos. 3,682,637 and 4,309,100 in that its photosensitive or emulsion layer exhibits a greater adhesion to the sheet material 32 then to the next adjacent layer(s) of the film 42 whereby stripping the sheet material 32 from the film 42 serves to remove the emulsion layer thus increasing the visual acuity and brightness of the resultant positive transparency and enhancing its stability by virtue of the removal of residual processing liquid in the emulsion layer. The fluted roller 36 also functions to prevent any build-up of this material by transferring any excess amounts from one side of the roller 36 to its other side in much the same way that it handled the aforementioned puddle of processing liquid.

The fluted idler roller 36 is mounted between the side walls of the kit to guide the strip 32 around the turn intermediate the roller 34 and the nozzle 30. The flutes are of sufficient depth to accommodate the volume of processing liquid displaced by the ridges or projections of the roller 36 as the strip 32 moves around the roller 36. Thus, there is essentially no transverse liquid movement on the roller 36. Essentially all the remaining processing liquid 26 remains on the strip 32 when it is rewound on roller 34.

Note that there are four flutes and ridges on idler roller 36, that the flutes are aligned on the roller axially with the axis of the roller and that no more than three-fourths (or three) of the ridges will ever be in contact with the strip of sheet material 32 at any one time. Note also that the radial thickness of the strip of sheet material 32 on roller 34 shown in FIG. 2 is exaggerated to a certain extent. The angle formed by the sheet material 32 extending in both directions from the idler roller 36 is about 90°, but can range between 85° and 95° depending on the radial thickness of the roll of sheet material left on the roller 34 at any one time. The reason for minimizing the contact area of the roller 36 with the strip of sheet material 32 is to minimize transverse displacement of processing liquid on the strip 32. The fact that the axes of rollers 34 and 36 are paralled and that the minimal contact surface of the ridges of roller 36 are parallel to both axes minimizes any tendency for sideward migration of the strip of sheet material 32 within the kit 16.

Another attribute of the above-described kit is the ability of the fluted idler roller 36 to substantially purge itself of any processing liquid located within the flutes during the last part of the rewinding of the sheet material 32. Specifically, it should be noted that the first six or seven inches of the sheet material 32, i.e., the length between the take-up roller 18 and the nozzle 30 as viewed in FIG. 2, is not originally coated with a layer of the processing liquid 26. Therefore, this uncoated length of sheet material 32 is dry when it engages the fluted idler roller 36 during the rewinding phase, and provides a vehicle for readily receiving any processing liquid located within the flutes of the idler roller 36. Thus, this newly coated six inches of sheet material is wound upon the roller 34 where the processing liquid 26 is imbibed by the sheet material 32, rather than being left on the flutes where it may subsequently drip onto components of the film processing apparatus 10.

Since certain changes may be made in the above apparatus without departing from the scope of the invention herein involved, it is intended that all matter contained in the above description or shown in the accompanying drawings shall be interpreted as illustrative and not in a limiting sense.

What is claimed is:

1. A disposable kit configured to be placed within a film processing apparatus wherein it is adapted for use in the processing of a photographically exposed roll of instant type transparency film, said kit comprising:

a housing having a container of processing liquid mounted therein, said container including a nozzle configured to dispense said liquid onto a strip of sheet material;

a roller rotatably supported within said housing;

a length of sheet material wound on said roller with a first end secured thereto and a second end extending (1) into engagement with said nozzle to receive a coating of said liquid and, (2) thence to the exterior of said housing, said sheet material being adapted to be partially withdrawn from the housing with a coating of liquid on one surface and to be pressed against an exposed length of film to form a laminate;

means coupled to one end of said roller and adapted to be driven in a direction for retracting said sheet material into the housing past said nozzle; and a rotatable idler roller supported within said housing for engaging the coated surface of said sheet material and facilitating a change in direction of movement of said sheet material, said idler roller being located intermediate said roller upon which said sheet material is wound and said nozzle, said idler roller having an axis about which it rotates, means on said idler roller for minimizing the flow of processing liquid in the axial direction when said idler roller is in contact with the coated surface.

2. A disposable kit as defined in claim 1 wherein said means on said idler roller for minimizing flow of processing liquid comprises spaced projections.

3. A disposable kit as defined in claim 1 wherein said means on said idler roller for minimizing flow of processing liquid comprises radially projecting ridges.

4. A disposable kit as defined in claim 1 wherein said means on said idler roller for minimizing flow comprises a plurality of parallel flutes separated by radially extending axially aligned ridges.

5. A disposable kit as defined in claim 4 wherein said plurality of flutes comprises four flutes separated circumferentially by smoothly curved ridges.

6. A disposable kit as defined in claim 5 wherein said idler roller always has at least two and less than four ridges in contact with said sheet material.

7. A disposable kit as defined in claim 4 wherein at least half of said ridges are always in contact with said sheet material.

8. A disposable kit as defined in claim 4 wherein no more than three-fourths of said ridges are ever in contact with said sheet material at any one time.

9. A disposable kit as defined in claim 4 wherein the angle subtended by said sheet material extending in both directions from the said idler roller is in the range of 85–95 .

10. A disposable kit as defined in claim 1 wherein the angle subtended by said sheet material extending in both directions from said idler roller is in the range 85–95 .

11. A disposable kit as defined in claim 6 wherein the angle subtended by said sheet material extending in both directions from said idler roller is in the range 85–95 .

12. A disposable kit as defined in claim 11 wherein said roller upon which said sheet material is wound has an axis parallel to said axis of said idler roller.

13. A disposable kit as defined in claim 1 wherein said roller upon which said sheet material is wound has an axis parallel to said axis of said idler roller.

* * * * *